United States Patent [19]

Solomon

[11] Patent Number: 4,811,182

[45] Date of Patent: Mar. 7, 1989

[54] COLOR CHANGER

[75] Inventor: Dennis Solomon, Yarmouth Port, Mass.

[73] Assignee: Altman Stage Lighting Co., Yonkers, N.Y.

[21] Appl. No.: 939,348

[22] Filed: Dec. 8, 1986

[51] Int. Cl.[4] ..... F21V 9/00

[52] U.S. Cl. ..... 362/293; 362/321; 353/93; 353/84

[58] Field of Search ..... 362/293, 16, 18, 223, 362/222, 321, 804; 353/97, 88, 90, 91, 93, 84

[56] References Cited

U.S. PATENT DOCUMENTS

| | | | |
|---|---|---|---|
| 2,735,929 | 2/1956 | Erhardt et al. | 362/321 |
| 2,856,831 | 10/1958 | Gipe et al. | 362/321 X |
| 3,222,510 | 12/1965 | Snyder | 362/293 |
| 4,210,955 | 7/1980 | Labrum | 362/321 |
| 4,298,920 | 11/1981 | Gluck et al. | 362/293 X |
| 4,458,303 | 7/1984 | Berns | 362/321 |
| 4,618,918 | 10/1986 | Zhabokrug | 362/293 X |

FOREIGN PATENT DOCUMENTS

| | | | |
|---|---|---|---|
| 687362 | 1/1940 | Fed. Rep. of Germany | 362/321 |

*Primary Examiner*—Larry Jones

*Attorney, Agent, or Firm*—27ckenbach Siegel Marzullo & Aronson

[57] ABSTRACT

A color changer system mounted at the light beam emission end of a luminaire. The system includes a support frame secured to the housing and disposed transverse to the beam, a plurality of iris units each having a plurality of colored, translucent leaves rotatably attached to the support frame, and a circular control plate rotatably mounted to the support frame and having a control slot in which a thrust pin of each leaf is slidably movable and a control handle. The support frame and the control plate each have circular apertures with centers that are aligned with the beam axis. When the control plate is rotated, the leaves of each iris unit open or close in response to pressure against the thrust pin so as to control the coloring of the light beam. The leaves move inwardly from the periphery of the light beam towards the beam axis towards a closed position or move away from the beam axis so as to intercept all or a portion of the light beam to color the portion of the light beam passing through the intercepting leaves. The leaves of each iris unit each have a different color from the leaves of the other iris units, with the colors preferably including the primary colors of the spectrum.

11 Claims, 4 Drawing Sheets

COLOR CHANGER

This invention relates generally to spotlight systems and more particularly to a spotlight apparatus mounted with a spotlight for changing the colors of the spotlight beam.

BACKGROUND OF THE INVENTION

Spotlights are generally called upon to throw not only white, or colorless, beams but also color beams of varying colors, hues, and intensities that can be selected by an operator from a range of colors and color combinations across the complete range of the color spectrum.

One color changer mechanism known in the art uses a series of individually hinged color lenses, or boomerangs, each of a basic color of the light spectrum and hinged at the end of the spotlight housing so that any or any combination of the colored lenses can be rotated by an operator to a position at the emission end of the beam. The colors of the color lenses are such that the range of the spectrum is available. In the most elementary operation, the operator selects one color lens then rotates the selected lens across the light beam. In more complex operations, two or more selected color lenses, which when mated with one another will produce a desired color, can be rotated across the light beam. This type of mechanism is shown in a brochure entitled "Colortran" issued by Colortran, Inc., 1015 Chestnut Street, Burbank, Calif., dated 5/84. One problem with this mechanism is that the color lenses must ride across the white or colored beam so that the changeover movement is not smoothly accomplished. Another problem is that the operator's hand must rotate a full half circle to accomplish the task of placing the selected color lens in front of the light beam. Yet another problem is that the lens being rotated in front of the light beam must be placed across the entire beam rather than just a part of the beam, since the lens is cutting into the beam from one side and a split colored-white beam is undesirable.

SUMMARY OF THE INVENTION

Accordingly, it an object of the present invention to provide a color changer system for a spotlight that can be easily operated to change the color of the light beam being projected in a subtle manner.

It is another object of this invention to provide a color changer system for a spotlight that moves the color being added to the light beam from the outer area of the beam towards the center of the beam.

It is still another object of the present invention to provide a color changer system for a spotlight that can be easily and quickly operated.

It is yet another object of the present invention to provide a color changer system for a spotlight that includes a plurality of iris valve units each of which closes a plurality of colored leaves from the periphery of the beam to the center of the beam or vice versa so that the beam can be colored gradually towards or decolorized from the center.

The present invention achieves the above objects by converting a shutter-type dimmer mechanism known in the art to a color changer system for a spotlight. Some prior patents of shutter mechanisms are listed below:

| Pat. No. | Date | Inventor |
|---|---|---|
| 1,049,554 | Jan. 7, 1913 | Wooden |
| 1,755,175 | Apr. 22, 1930 | Dina |
| 1,881,521 | Oct. 11, 1932 | Gstyr et al. |
| 2,307,273 | Jan. 5, 1943 | Hughes |
| 2,735,929 | Feb. 21, 1956 | Erhardt et al. |
| 3,621,766 | Nov. 23, 1971 | Giesecke |

The patent to Wooden especially has features that are used in the present invention.

The present invention includes a color changer system mounted at the light beam emission end of a luminaire housing. The system includes a support frame secured to the housing disposed transverse to the beam, a plurality of iris units each having a plurality of colored, translucent leaves rotatably attached to the support frame, and a circular control plate rotatably mounted to the support frame and having a control slot in which a thrust pin of each leaf is slidably movable and a control handle. The support frame and the control plate each have circular apertures with centers that are aligned with the beam axis. When the control plate is rotated, the leaves of each iris unit open or close in response to pressure by the control plate against a thrust pin so as to control the coloring of the light beam. The leaves move inwardly from the periphery of the light beam towards the beam axis towards a closed position or move away from the beam axis so as to intercept all or a portion of the light beam so as to filter the light beam through the intercepting leaves so as to color that portion of the intercepted beam. The leaves of each iris unit each have a different color from the leaves of the other iris units, with the colors preferably including the primary colors of the spectrum.

The present invention will be better understood and the objects and important features, other than those specifically enumerated above, will become apparent when consideration is given to the following details and description, which when taken in conjunction with the annexed drawings, describes, discloses, illustrates, and shows a preferred embodiment or modification of the present invention and what is presently considered and believed to be the best mode of practice in the principles thereof.

DESCRIPTION OF THE PREFERRED EMBODIMENT

Figure 1:
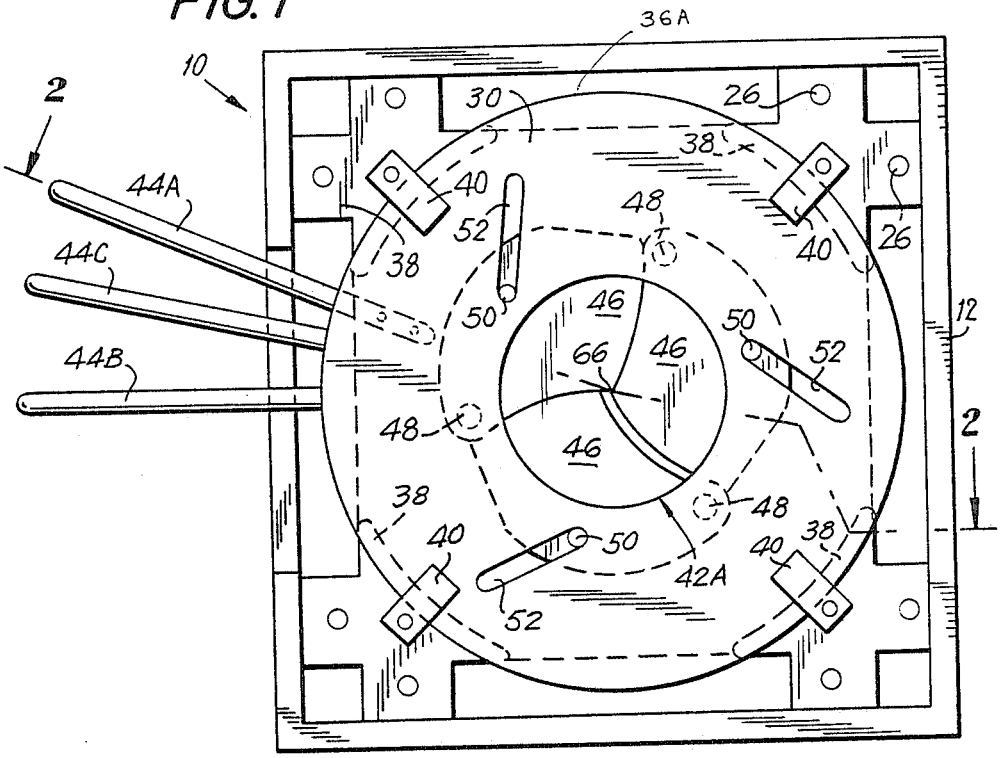
FIG. 1 is an elevational view of one side of the color changer system having four iris units with front and rear iris units in fully closed modes and two middle iris units in partly closed modes.
Figure 2:
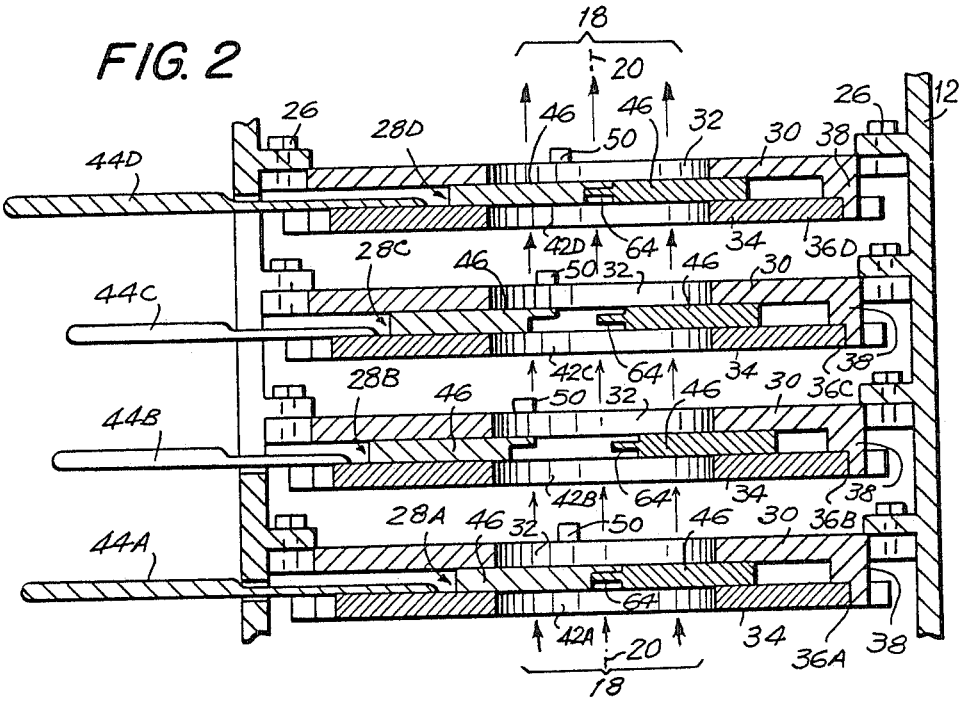
FIG. 2 is a sectional view taken through line 2—2 of FIG. 1.
Figure 3:
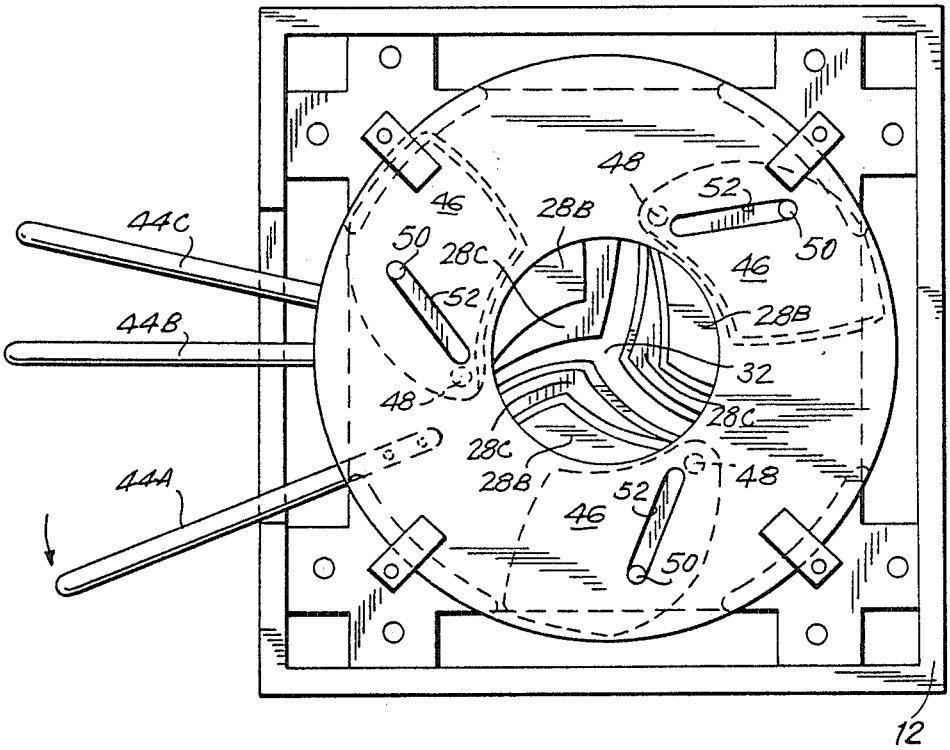
FIG. 3 is an elevational view of one side of the color changer system similar to FIG. 1 except that the front and rear iris units are in fully open modes.
Figure 4:
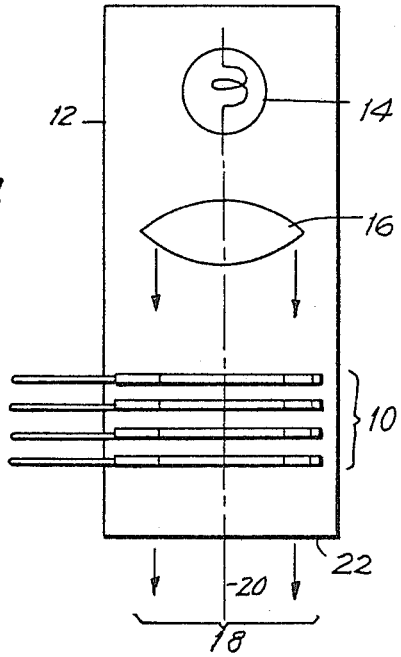
FIG. 4 is a simplified schematic view of the color changer system shown mounted in a luminaire.

A color changer system 10 is illustrated in isolation in FIGS. 1–3 and schematically mounted in a luminaire, or housing, 12 in FIG. 4. Housing 12 contains a light source 14 and a lens 16, but may include a number of other devices known in the art of stage illumination including an iris, a shutter, a mechanical dimmer, and an extended lens system. Light source 14 emits a light beam 18 centered about an axis 20. Beam 18 is emitted generally as a colorless, or white, beam and is directed to the beam emission end 22 of housing 12. A series of iris units 28A, 28B, 28C, and 28D each rotatably connected to its own generally flat support frame 30 are positioned perpendicular to beam 18 and secured to housing 12 at beam emission end 22 by a number of bolts 26 in a manner known in the art. Iris units 28A–28D are slightly spaced apart and parallel with one another with iris unit 28A nearest to entering beam 18 from light source 14 and iris unit 28D farthest. Each of the four support frames 30 has a circular aperture 32 having a center that is aligned with axis 20. Four flat control plates 34A–34D having reverse flat surfaces and circular circumferential edges 36A–36D are rotatably mounted parallel to each support frame 30 at four diametrically positioned arced, stepped support bosses 38 that extend from the beam-facing surface of each support plate 30. The first step of each arc of support bosses 38 is spaced from the beam-facing surface of support frame 30, so that a space is formed between each control plate 34A–34D and each support frame 30; iris units 28A–28D are positioned in the spaces so formed. Each control plate 34A–34D is rotatably positioned in the arcs of stepped supports 38 at circumferential edges 36A–36D so as to be freely rotatable laterally relative to each support frame 30 and iris units 28A–28D. Four hold-down members 40 have their one end screwed into each support frame 30 at stepped supports 38 and their opposite ends pressed against the beam-facing flat surface of each of control plates 34A–34D so as to keep each control plate rotatably mounted to each support frame 30. Each control plate 34A–34D has a respective central aperture 42A–42D of the same radius as aperture 32 of support frame 24 and having a center aligned with beam axis 20. Four control handles 44A–44D include hand gripping portions that extend outwardly from circumferential edges 36A–36D to connecting portions that are secured to control plates 34A–34D, respectively, by a pair of screws. The connecting portions of handles 44A–44D are disposed in the space between each iris unit 28A–28D and each support frame 30.

Each of the iris units 28A–28D includes three similarly shaped, colored or filtered, translucent iris leaves 46, which are centered about and disposed perpendicular to beam axis 20. A single iris leaf 46 is shown in isolation in FIGS. 5 and 6. Each leaf 46 is rotatably mounted to the beam-facing surface of support frame 24 by a pivot member 48, which is rotatably positioned in pivot holes in the beam-facing surface of support frame 24. A thrust pin 50 extends perpendicularly from the reverse surface from pivot member 48 of each leaf 46. Each control plate 34A–34D has an elongated control slot 52 in which a thrust pin 50 is engaged and slidingly movable along the slot as will be explained in detail below.

Leaves 46 of each set of iris units 28A–28D is colored differently from the other. As shown in FIGS. 1–3, the iris leaves 46 of iris unit 28A is of one primary color, he iris leaves 46 of iris unit 28B is of a second primary color, and the iris leaves 46 of iris unit 28C is of a third primary color. Leaves 46 of iris unit 28D are of a neutral, tinted shade that function to subdue the intensity of the colors of iris units 28A–28C.

Each of the iris units 28A–28D is movable between an open position and a closed position including a plurality of intermediate positions between the open and closed positions. In the open position beam 18 passes iris leaves 46, which are rotatably completely withdrawn from aperture 42 of support frame 30. In the closed position beam 18 passes through the three translucent leaves 46, which completely cover aperture 42 so that beam 18 is fully colored in accordance with the particular color of the leaves of the particular iris unit that is closed. In the plurality of intermediate positions leaves 46 of each iris unit are successively positioned across a portion of beam 18 and extend from the periphery of beam 18 to positions spaced from beam axis 20. As leaves 46 are simultaneously moved inwardly or outwardly, they close toward or from beam axis 20, respectively, so that an increasingly less or greater amount of light passes through the apertures centered around beam axis 20.

In operation an operator moves one of the control handles 44A–44D for its respective control plate 34A–34D and rotates the control plate by upward or downward movement of the control handle. For example, in FIGS. 1 and 2 control handle 44A is in a raised position and leaves 46 of iris unit 28A completely cover aperture 32 so that beam 18 is completely colored by the first primary color upon passing through translucent leaves 46. In FIG. 3 control handle 44A has been moved to a down position so that leaves 46 of iris unit 28A have been completely withdrawn from aperture 32 of its support frame 30 so that beam 30 is not colored as it passes iris unit 28A. In FIGS. 1–3 iris unit 28B is shown with its leaves 46 in a half-closed position so that beam 18 is colored by the second primary color around the outer portion of the beam from the periphery of the beam to about half the radius of the beam while the remaining center portion centered about beam axis 20 is uncolored. Iris unit 28C is shown in about a three-quarters closed position with beam 20 colored with the second primary color about three-fourths of the radial distance from its periphery with about one-fourth of the radial distance from beam axis 20 uncolored. In FIG. 3 leaves 46 of each control unit 28B and 28B are indicated as the control units themselves for purposes of illustration so that the positions of the leaves in each position can be seen. Iris unit 28D is shown in a completely closed position.

When the selected control plate 34A–34D is rotated, thrust pin 50 is pressured by the side walls of elongated control slot 52 from its former position relative to its support plate 30A–30D to a new position. In general, thrust pins 50 are positioned proximate apertures 42A–42D when leaves 46 are in their closed mode as shown for control plate 34A in FIGS. 1 and 2 and are positioned distant from apertures 42–42A when leaves 46 are in their closed mode as shown for control plate 34A in FIG. 3. In the intermediate positions, thrust pin 50 is forced to intermediate positions between the proximate and distant positions just discussed from the control plate aperture so that leaves 46 are positioned partly across beam 20.

Figure 5:
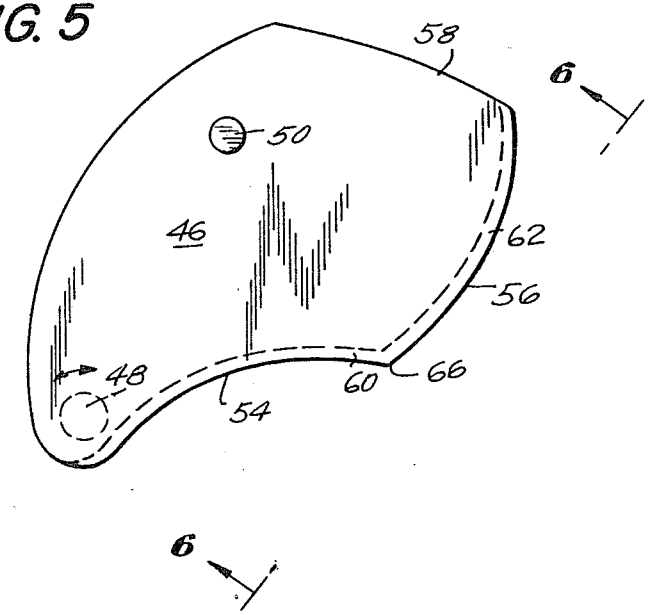
FIG. 5 is an isolated top view of one of the three leaves of the iris units.
Figure 6:
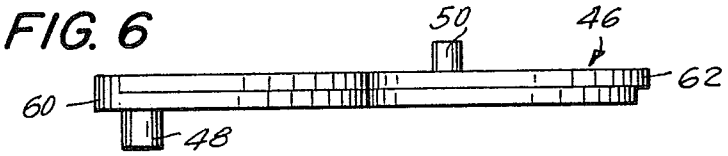
FIG. 6 is a side view of the leaf in FIG. 5 taken through line 6—6.

The exact configuration of leaves 46 is illustrated in FIG. 5. An inwardly curved wall 54 of each leaf 46 aligns with apertures 42A–42D when in the completely open mode, and in the closed mode inwardly curved wall 54 fits against an outwardly curved wall 56 of the adjoining leaf. Another outwardly slightly curved wall 58 is pressed against a portion of a support boss 38 when leaf 46 is in its open mode. Two of leaves 46 have projecting edges, or lips, 60 and 62 along walls 54 and 56, respectively. In the leaf shown in FIG. 5, lips 60 and 62 project from the beam-facing surface of leaf 46, but its mating leaf in the closed mode has its lips projecting from the reverse surface so that the lips lock. The third leaf 46 has a middle lip 64, seen best in FIG. 2, projecting from walls 54 and 56 so that the lips from the other two leaves fit above and below lip 64. The three leaves 46 converge at a central point 66 aligned with beam axis 20 at the juncture of walls 54 and 56 when the three leaves 46 are in their fully closed mode. The number of leaves for each iris unit may vary from the three leaves shown herein. The leaves may be made any of a variety of materials including colored plastic material or colored glass with a metal support trim.

Figure 7:
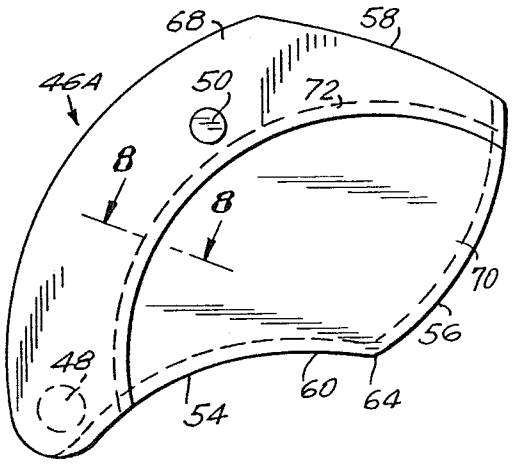
FIG. 7 is a front view of a leaf having a mounting portion and a translucent portion.
Figure 8:
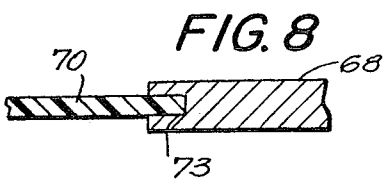
FIG. 8 is a sectional view taken through line 8—8 in FIG. 7.

FIGS. 7 and 8 illustrate an alternate embodiment of a leaf indicated as leaf 46A, which includes a mounting portion 68 and a translucent portion 70. Mounting portion 68 is made of a stronger material than translucent portion 70. Mounting portion 68 is never positioned so as intercept light rays 20. Mounting portion 68 and translucent portion 70 are joined along an annular juncture 72, which is aligned with the circular edge of circular apertures 42A–42D of control plates 34A–34D when the leaves are in their closed mode. Mounting portion 68 has an annular slot 73 along the concave side of juncture 72 that is adapted to slidably position the convex side of translucent portion 70. Mounting portion 68 and translucent portion 70 are cemented together.

Figure 9:
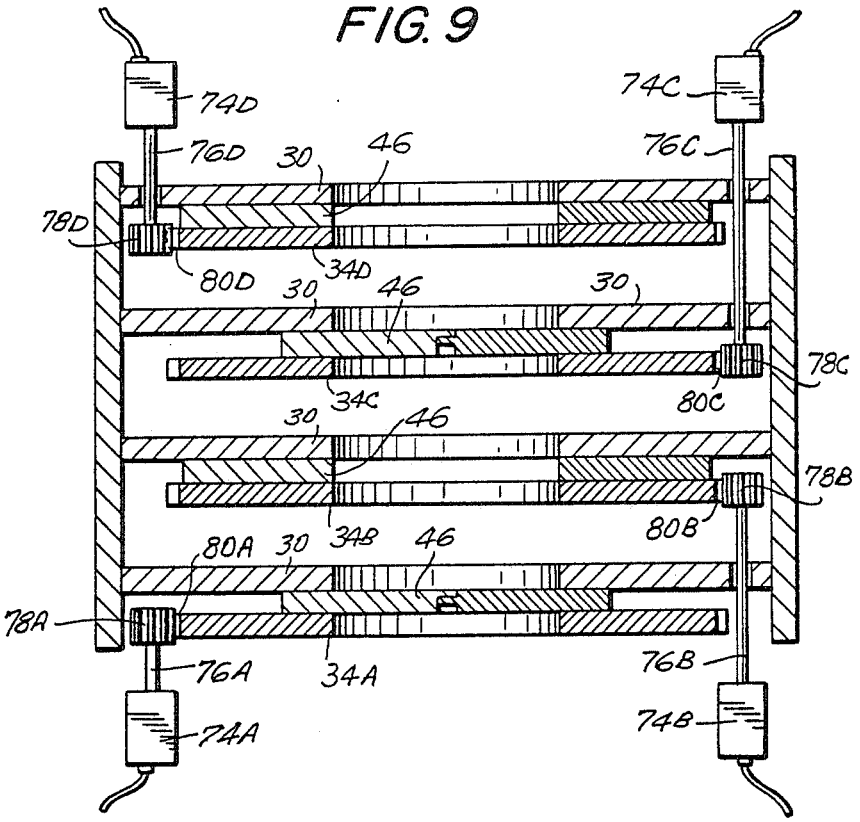
FIG. 9 is a simplified view of an alternative embodiment of the invention similar to the view shown in FIG. 2 showing the control plates controlled by drive gears of motors.
Figure 10:
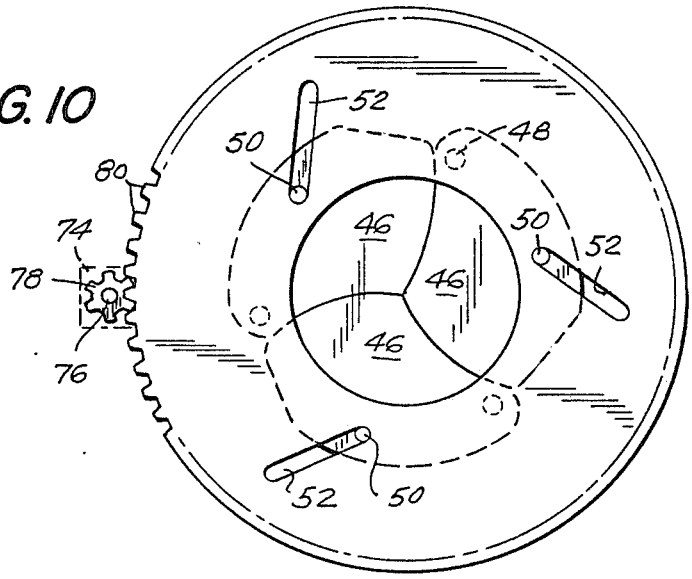
FIG. 10 is an isolated view of a single control plate controlled by a drive gear connected to a motor.

FIGS. 9 and 10 illustrate an alternative embodiment of the controls for control plates 34A–34D to control handles 44A–44D discussed earlier. FIG. 9, which is a slightly simplified version of the view shown in FIG. 2, shows four motors 74A–74D with their drive shafts 76A–76D, respectively, connected to drive gears 78A–78D, respectively, which are geared to gear teeth 80A–80D of control plates 34A–34D, respectively. FIG. 10 illustrates a typical control system for a typical control plate 34 having gear teeth 80 over a portion the circumference of the control plate. A motor 74, shown in phantom line, rotates drive shaft 76 and drive gear 78 at the end of the drive shaft. Drive gear 78 is geared to gear teeth 80. Controls for each motor lead to a control panel (not shown) so as to give the operator the ability to control all the iris leaves 46 operated by control plates 34A–34D.

The embodiment of the invention particularly disclosed and described herein above is presented merely as an example of the invention. Other embodiments, forms, and modifications of the invention coming within the proper scope and spirit of the appended claims will, of course, readily suggest themselves to those skilled in the art.

What is claimed is:

1. A color changer system mounted in a luminaire that contains at least one light source emitting a beam of white light and one lens, said beam having a cross sectional axis and said luminaire having a beam emission end, comprising, in combination, at least one support means mounted in said luminaire and having an aperture which passes said beam of white light, iris means connected to said support means, said iris means being adapted for coloring said beam of white light and being movable between an open position and a closed position including a plurality of intermediate positions between said open and closed positions, wherein in said open position the beam of white light passes said iris means uncolored by said iris, means and in said closed position the beam is fully colored, and wherein in said plurality of intermediate positions said iris means during movement between said open and closed positions is successively positioned across portions of the beam extending from the periphery of the beam to positions spaced from the axis of the beam, said iris means comprising an iris unit having a plurality of colored, translucent leaves centered about and disposed transverse to the beam axis, and each leaf being rotatably mounted to said support means by a pivot member, each of said plurality of leaves being simultaneously rotatable about each said pivot member by control means connected to said iris means and said at least one support means for selectively positioning said iris means at any of said open, closed, or intermediate positions, and said control means wherein said control means including a control plate supporting said at least one iris unit, said control plate forming another aperture aligned with said aperture of said support means, said control plate being rotatably connected to said support means, each of said plurality of leaves being slidably connected to said control plate for rotation of said leaves as said control plate is rotated, wherein each of said plurality of leaves has a first side surface and a second reverse side surface and has a pivot connected to said first side surface rotatably mounted to said support means, whereby said plurality of leaves are rotatably movable about said pivot between said open and closed positions, and wherein each of said plurality of leaves includes a thrust pin extending transversely from said second side surface of each of said plurality of leaves, and said control plate has a plurality of elongate slots having opposed ends, each said thrust pin being engaged in and slidably movable along said slot during rotation of said control plate about each said pivot to selected position between or at said opposed ends which correspond to said open and closed modes.

2. The color changer system according to claim 1, wherein said at least one support means includes a plurality of support means, said irs unit includes a plurality of iris units each spaced proximate one another and centered about the beam axis, and said control plate includes a plurality of control plates.

3. The color changer system according to claim 1, wherein each of said plurality of iris units have a plurality of leaves of the same color for each of said iris units, each color of said leaves being of a different color from the leaves of the other of said plurality of said iris units.

4. The color changer system according to claim 3, wherein said each color of said plurality of leaves includes the primary colors wherein the colors of the color spectrum can be duplicated.

5. The color changer system of claim 1, wherein said plurality of leaves of each said iris units includes three leaves.

6. The color changer system of claim 5, wherein said iris unit is positioned between said support means and said control plate.

7. The color changer system of claim 1, wherein said aperture of said support means and said another aperture of said control plate are circular apertures of the same diameter having centers aligned with the beam axis.

8. A color changer system mounted in a luminaire that contains at least one light source emitting a beam of white light and one lens, said beam having a cross-sectional axis and said luminaire having a beam emission end, comprising, in combination, at least one support means mounted in said luminaire and having an aperture which passes said beam of white light, iris means connected to said support means, said iris means being adapted for coloring said beam of white light and being movable between an open position and a closed position including a plurality of intermediate positions between said open and closed positions, wherein in said open position the beam of white light passes said iris means uncolored by said iris means and in said closed position the beam is fully colored, and wherein in said plurality of intermediate positions said iris means during movement between said open and closed positions is successively positioned across portions of the beam extending from the periphery of the beam to positions spaced from the axis of the beam, said iris means comprising an iris unit having a plurality of colored, translucent leaves centered about and disposed transverse to the beam axis, and each leaf being rotatably mounted to said support means by a pivot member, each of said plurality of leaves being simultaneously rotatable about each said pivot member by control means connected to said iris means and said at least one support means for selectively positioning said iris means at any of said open, closed, or intermediate positions, and said control means wherein said control means including a control plate supporting said at least one iris unit, said control plate forming another aperture aligned with said aperture of said support means, said control plate being rotatably connected to said support means, each of said plurality of leaves being slidably connected to said control plate for rotation of said leaves as said control plate is rotated, wherein said control plate has a circular edge and said support means includes a plurality of stepped support bosses having arced steps which rotatably position said control plate at said circular edge, and further including a plurality of hold-down elements having one end secured to said support means and an opposed end in pressing contact with said control plate.

9. The color changer system of claim 8, wherein said control plate is in contact with said plurality of said bosses, said control plate and said support means forming a space therebetween, said iris unit being positioned in said space.

10. A color changer system mounted in a luminaire that contains at least one light source emitting a beam of white light and one lens, said beam having a cross-sectional axis and said luminaire having a beam emission end, comprising, in combination.

at least one support means mounted in said luminaire and having an aperture which passes said beam of white light, iris means connected to said support means, said iris means being adapted for coloring said beam of white light and being movable between an open position and a closed position including a plurality of intermediate positions between said open and closed positions, wherein in said open position the beam of white light passes said iris means uncolored by said iris means and in said closed position the beam is fully colored, and wherein in said plurality of intermediate positions said iris means during movement between said open and closed positions is successively positioned across portions of the beam extending from the periphery of the beam to positions spaced from the axis of the beam.

said iris means comprising an iris unit having a plurality of colored, translucent leaves centered about and disposed transverse to the beam axis, and each leaf being rotatably mounted to said support means by a pivot member, each of said plurality of leaves being simultaneously rotatable about each said pivot member by control means connected to said iris means and said at least one support means for selectively positioning said iris means at any of said open, closed, or intermediate positions, and said control means wherein said control means including a control plate supporting said at least one iris unit, aid control plate forming another aperture aligned with said aperture of said support means, said control plate being rotatably connected to said support means, each of said plurality of leaves being slidably connected to said control plate for rotation of said leaves as said control plate is rotated, and wherein said control plate further includes a control handle connected to said control plate, said control handle extending beyond said luminaire, whereby an operator has access to the control handle to rotate said control plate and said iris unit to a selected position.

11. A color changer system mounted in as luminaire that contains at least one light source emitting a beam of white light and one lens, said beam having a cross-sectional axis and said luminaire having a beam emission end, comprising, in combination.

at least one support means mounted in said luminaire and having an aperture which passes said beam of white light, iris means connected to said support means, said iris means being adapted for coloring said beam of white light and being movable between an open position and a closed position including a plurality of intermediate positions between said open and closed positions, wherein in said open position the beam of white light passes said iris means uncolored by said iris means and in said closed position the beam is fully colored, and wherein in said plurality of intermediate positions said iris means during movement between said open and closed positions is successively positioned across portions of the beam extending from the periphery of the beam to positions spaced from the axis of the beam, said iris means comprising an iris unit having a plurality of colored, translucent leaves centered about and disposed transverse to the beam axis, and each leaf being rotatably mounted to said support means by a pivot member, each of said plurality of leaves being simultaneously rotatable about each said pivot member by control means connected to said iris means and said at least one support means for selectively positioning said iris means at any of said open, closed, or intermediate positions, and said control means wherein said control means including a control plate supporting said at least one iris unit, said control plate forming another aperture aligned with said aperture of said support means, said control plate being rotatably connected to said support means, each of said plurality of leaves being slidably connected to said control plate for rotation of said leaves as said control plate is rotated, and wherein said control means further includes said control plate having a circumferential portion having gear teeth, motor mounted in association with said luminaire, a drive shaft extending rom said motor to said control plate, a drive gear positioned at the end of said drive shaft and geared with said gear teeth, wherein when said motor is activated, said drive gear rotates said control plate so as to open or close said irs unit to a selected position.

* * * * *